US010465962B2

(12) United States Patent
Ignatiev et al.

(10) Patent No.: US 10,465,962 B2
(45) Date of Patent: Nov. 5, 2019

(54) COMPRESSOR WITH COOLING SYSTEM

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 212 days.

(21) Appl. No.: 15/339,012

(22) Filed: Oct. 31, 2016

(65) Prior Publication Data

US 2017/0138643 A1 May 18, 2017

Related U.S. Application Data

(60) Provisional application No. 62/255,701, filed on Nov. 16, 2015.

(51) Int. Cl.

| | |
|---|---|
| ***F25B 41/00*** | (2006.01) |
| ***F25B 49/02*** | (2006.01) |
| ***F25B 31/00*** | (2006.01) |

(52) U.S. Cl.

CPC ..... *F25B 49/02* (2013.01); *F25B 31/006* (2013.01); *F25B 2400/0409* (2013.01)

(58) Field of Classification Search

CPC .. F25B 1/10; F25B 5/02; F25B 31/006; F25B 31/008; F25B 2341/0662; F25B 2400/23; F25B 2400/0409

See application file for complete search history.

(56) References Cited

U.S. PATENT DOCUMENTS 2,793,506 A 5/1957 Moody
4,899,555 A * 2/1990 Shaw ..... F25B 5/04 62/505

(Continued)

FOREIGN PATENT DOCUMENTS

WO WO-2007111594 A1 10/2007
WO WO-2009098899 A1 8/2009

OTHER PUBLICATIONS

International Search Report regarding International Application No. PCT/US2016/060990, dated Feb. 7, 2017.

(Continued)

*Primary Examiner* — Jonathan Bradford
(74) *Attorney, Agent, or Firm* — Harness, Dickey & Pierce, P.L.C.

(57) ABSTRACT

A system may include first and second compressors, first and second heat exchangers, a flash tank, and first, second and third fluid paths. The first compressor may include first and second inlets. The second compressor may receive fluid from an outlet of the first compressor. The first heat exchanger may receive fluid from the second compressor. The flash tank may receive fluid from the first heat exchanger and includes a vapor outlet and a liquid outlet. The second heat exchanger may be in fluid communication with the flash tank and may receive fluid from the liquid outlet. The first fluid path extends from an outlet of the second heat exchanger to an inlet of the second compressor. The second fluid path extends from the vapor outlet to the first fluid path. The third fluid path may transmit fluid from the vapor outlet to the second inlet.

19 Claims, 2 Drawing Sheets

(56) References Cited

U.S. PATENT DOCUMENTS

Figure 1:
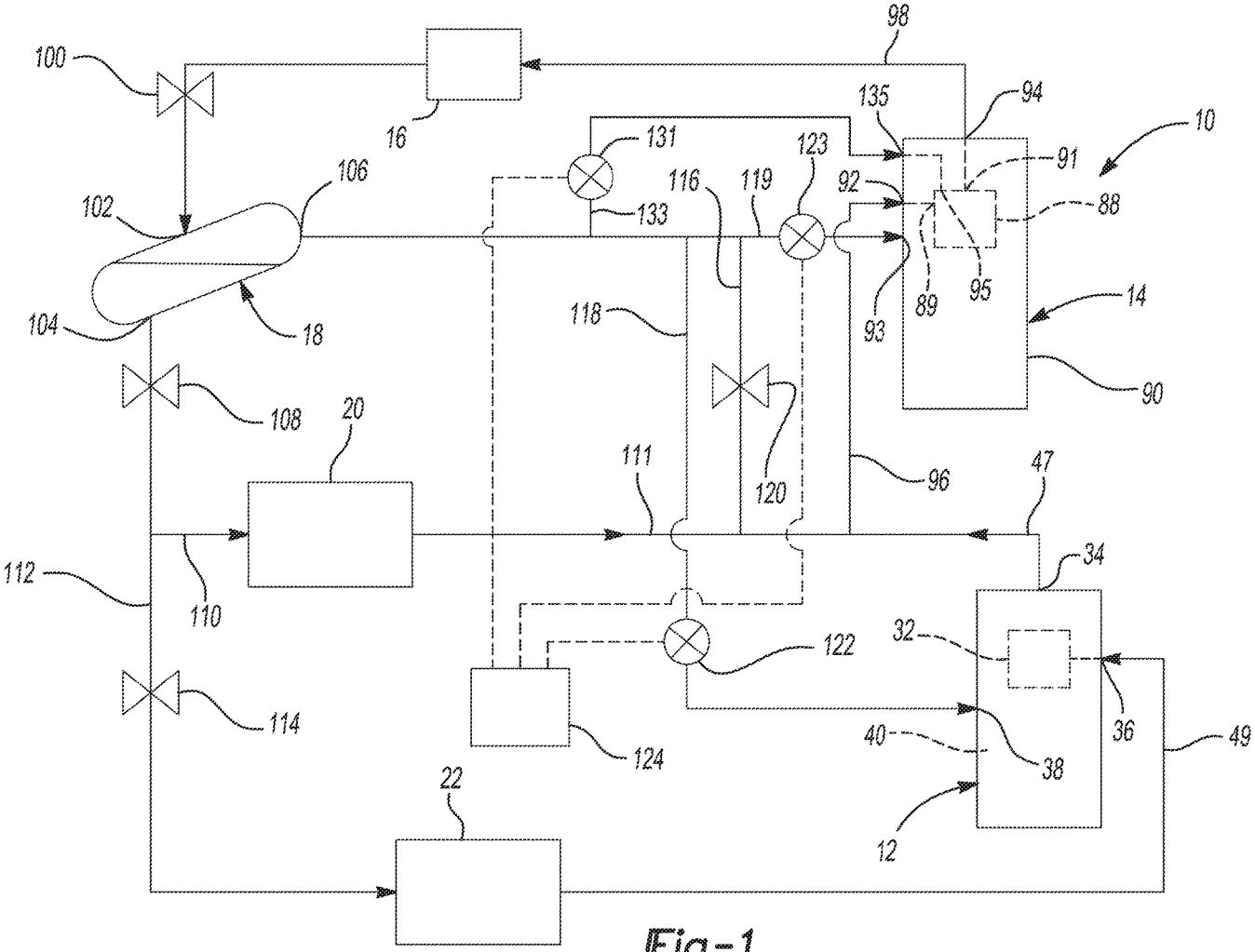

| | | | | |
|---|---|---|---|---|
| 5,103,650 | A * | 4/1992 | Jaster | F25B 1/10 62/198 |
| 5,729,994 | A * | 3/1998 | Mukaiyama | F24F 5/0092 62/186 |
| 6,053,715 | A | 4/2000 | Hirano et al. | |
| 6,070,421 | A | 6/2000 | Petrovich et al. | |
| 2005/0204773 | A1 | 9/2005 | Imai et al. | |
| 2006/0010904 | A1 | 1/2006 | Nieter et al. | |
| 2008/0078204 | A1* | 4/2008 | Ignatiev | F25B 31/002 62/512 |
| 2009/0007589 | A1 | 1/2009 | Takegami et al. | |
| 2011/0023514 | A1 | 2/2011 | Mitra et al. | |
| 2011/0113804 | A1* | 5/2011 | Chin | F25B 1/04 62/222 |
| 2012/0227427 | A1* | 9/2012 | Liu | F25B 1/10 62/115 |
| 2013/0298593 | A1* | 11/2013 | Christensen | F25B 9/008 62/467 |
| 2014/0216102 | A1 | 8/2014 | Ignatiev et al. | |
| 2014/0326018 | A1 | 11/2014 | Ignatiev | |

OTHER PUBLICATIONS

Written Opinion of the International Searching Authority regarding International Application No. PCT/US2016/060990, dated Feb. 7, 2017.

Partial Search Report regarding European Patent Application No. 16866861.4, dated May 21, 2019.

* cited by examiner

COMPRESSOR WITH COOLING SYSTEM

CROSS-REFERENCE TO RELATED APPLICATIONS

This application claims the benefit of U.S. Provisional Application No. 62/255,701, filed on Nov. 16, 2015. The entire disclosure of the above application is incorporated herein by reference.

FIELD

The present disclosure relates to a compressor with a cooling system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a climate-control system that may include a first compressor, a second compressor, a first heat exchanger, a flash tank, a second heat exchanger, a first fluid path, a second fluid path, and a third fluid path. The first compressor may include a first compression mechanism, a first inlet, a second inlet and an outlet. The first compression mechanism may receive working fluid from the first inlet and discharge the working fluid through the outlet. The second compressor may be in fluid communication with the first compressor and may include a second compression mechanism receiving working fluid from the outlet of the first compressor. The first heat exchanger may be in fluid communication with the second compressor and may receive working fluid from the second compressor. The flash tank may be in fluid communication with the first heat exchanger and may receive working fluid from the first heat exchanger. The flash tank includes a vapor outlet and a liquid outlet. The second heat exchanger may be in fluid communication with the flash tank and may receive working fluid from the liquid outlet. The first fluid path may extend from an outlet of the second heat exchanger to an inlet (e.g., a first inlet) of the second compressor. The second fluid path may extend from the vapor outlet of the flash tank to the first fluid path. The third fluid path may be coupled to the second inlet of the first compressor. The third fluid path may transmit working fluid from the vapor outlet to the second inlet.

In some configurations, the first compression mechanism includes first and second scrolls defining fluid pockets therebetween that contain working fluid from the first inlet. Working fluid entering the first compressor through the second inlet may be fluidly isolated from the fluid pockets of the first compression mechanism.

In some configurations, working fluid entering the first compressor through the second inlet is fluidly isolated from the first compression mechanism.

In some configurations, working fluid flowing through the third fluid path is at a higher pressure than working fluid flowing through the outlet of the first compressor.

In some configurations, the second fluid path includes an expansion device, and working fluid in the second fluid path downstream of the expansion device is at a pressure substantially equal to the working fluid flowing through the outlet of the first compressor.

In some configurations, the climate-control system includes a third heat exchanger and a fourth fluid path. The third heat exchanger is in fluid communication with the flash tank and receives working fluid from the liquid outlet. The fourth fluid path may extend from an outlet of the third heat exchanger to the first inlet of the first compressor.

In some configurations, the second and third fluid paths bypass the second and third heat exchangers.

In some configurations, the climate-control system includes a pair of expansion devices through which working fluid from the liquid outlet of the flash tank passes before entering the third heat exchanger. Working fluid from the liquid outlet of the flash tank may pass through only one of the pair of expansion devices before entering the second heat exchanger.

In some configurations, the second and third heat exchangers are fluidly isolated from each other.

In some configurations, the first compression mechanism compresses working fluid from a first pressure to a second pressure, and the second compression mechanism compresses the working fluid from the second pressure to a third pressure.

In some configurations, the third fluid path includes a valve controlling fluid flow through the second inlet.

In some configurations, the valve is controlled based on a temperature within a shell of the first compressor.

In some configurations, an expansion device may be fluidly connected with an outlet of the first heat exchanger and an inlet of the flash tank.

In some configurations, the first inlet of the second compressor receives working fluid from the outlet of the first compressor.

In some configurations, the climate-control system may include a fourth fluid path coupled to a second inlet of the second compressor. The fourth fluid path may transmit working fluid from the vapor outlet to the second inlet of the second compressor.

In some configurations, the climate-control system may include a fifth fluid path fluidly connecting the vapor outlet to a third inlet of the second compressor. The third inlet may be fluidly connected to a vapor-injection port of the second compression mechanism.

In another form, the present disclosure provides a climate-control system that may include first and second compressors, a first heat exchanger, a flash tank, a second heat exchanger, a third heat exchanger, a first fluid path, a second fluid path, a third fluid path, and a fourth fluid path. The first compressor includes a first compression mechanism disposed within a shell. The shell may include a first inlet, a second inlet and an outlet. The first compression mechanism may include first and second scrolls defining fluid pockets therebetween that contain working fluid from the first inlet.

The first compression mechanism discharges the working fluid through the outlet. The second compressor may be fluid communication with the first compressor and may include a second compression mechanism receiving working fluid from the outlet of the first compressor. The first heat exchanger may be in fluid communication with the second compressor and may receive working fluid from the second compressor. The flash tank may be in fluid communication with the first heat exchanger and may receive working fluid from the first heat exchanger. The flash tank may include a vapor outlet and a liquid outlet. The second and third heat exchangers may be in fluid communication with the flash tank and may receive working fluid from the liquid outlet. The first fluid path may extend from an outlet of the second heat exchanger to a first inlet of the second compressor. The second fluid path may extend from the vapor outlet of the flash tank to the first fluid path. The third fluid path may be coupled to the second inlet of the first compressor. The third fluid path may transmit working fluid from the vapor outlet to the second inlet. Working fluid entering the first compressor through the second inlet may be fluidly isolated from the fluid pockets of the first compression mechanism. The fourth fluid path may extend from an outlet of the third heat exchanger to the first inlet of the first compressor.

In some configurations, the first inlet of the second compressor receives working fluid from the outlet of the first compressor.

In some configurations, the climate-control system includes a fifth fluid path coupled to a second inlet of the second compressor. The fifth fluid path may transmit working fluid from the vapor outlet to the second inlet of the second compressor.

In some configurations, the climate-control system includes a sixth fluid path fluidly connecting the vapor outlet to a third inlet of the second compressor.

In some configurations, the third inlet of the second compressor may be fluidly connected to a vapor-injection port of the second compression mechanism.

In another form, the present disclosure provides a method that may include compressing a working fluid from a first pressure to a second pressure in a first compressor; compressing the working fluid from the second pressure to a third pressure in a second compressor; separating vapor working fluid from liquid working fluid downstream of the second compressor; transferring heat to a first portion of the liquid working fluid in a first evaporator; transferring heat to a second portion of the liquid working fluid in a second evaporator; transmitting a first portion of the vapor working fluid through a first conduit to an inlet of the second compressor, the first conduit bypassing the first and second evaporators; transmitting a second portion of the vapor working fluid through a second conduit to an inlet of the first compressor, the second conduit bypassing the first and second evaporators; and circulating the second portion of the vapor working fluid within a shell of the first compressor and subsequently through an outlet of the shell without further compressing the second portion of the vapor working fluid in the first compressor.

In some configurations, circulating the second portion of the vapor working fluid within the shell of the first compressor may include cooling a motor assembly of the first compressor with the second portion of the vapor working fluid.

In some configurations, the method includes controlling fluid flow through the second conduit based on a temperature within the shell of the first compressor.

In some configurations, the method includes separating oil from the working fluid within a shell of the first compressor prior to compressing the working fluid in the second compressor.

In some configurations, the method includes transmitting a third portion of the vapor working fluid to vapor-injection port a compression mechanism of the second compressor.

In another form, the present disclosure provides a compressor that may include a shell, a first scroll, a second scroll, a motor assembly, a working-fluid-inlet conduit, and a working-fluid-inlet opening. The shell may define a discharge-pressure cavity. The first scroll may be disposed within the discharge-pressure cavity. The second scroll may be disposed within the discharge-pressure cavity and meshes with the first scroll to define fluid pockets therebetween. The first and second scrolls may compress a working fluid from a first pressure to a second pressure and discharge the working fluid into the discharge-pressure cavity. The motor assembly may be disposed within the discharge-pressure cavity and may drive the second scroll relative to the first scroll. The working-fluid-inlet conduit may be attached to the shell at a first opening and communicates with a suction inlet of the first scroll. The working-fluid-inlet conduit is fluidly isolated from the discharge-pressure cavity. The working-fluid-inlet opening may be formed in the shell and is in communication with the discharge-pressure cavity. The working-fluid-inlet opening may be fluidly isolated from the suction inlet of the first scroll.

In some configurations, the compressor includes an oil separator disposed within the discharge-pressure cavity.

In another form, the present disclosure provides a climate-control system that may include first and second compressors, first and second heat exchangers, a flash tank, and first, second and third fluid paths. The first compressor may include an outlet and a first compression mechanism discharging the working fluid through the outlet. The second compressor may be in fluid communication with the first compressor and may include a first inlet, a second inlet, and a second compression mechanism receiving working fluid from the first inlet. The first inlet may receive working fluid from the outlet of the first compressor. The first heat exchanger may be in fluid communication with the second compressor and may receive working fluid from the second compressor. The flash tank may be in fluid communication with the first heat exchanger and may receive working fluid from the first heat exchanger. The flash tank may include a vapor outlet and a liquid outlet. The second heat exchanger may be in fluid communication with the flash tank and may receive working fluid from the liquid outlet. The first fluid path may extend from an outlet of the second heat exchanger to the first inlet of the second compressor. The second fluid path may extend from the vapor outlet of the flash tank to the first fluid path. The third fluid path may be coupled to the second inlet of the second compressor. The third fluid path may transmit working fluid from the vapor outlet to the second inlet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
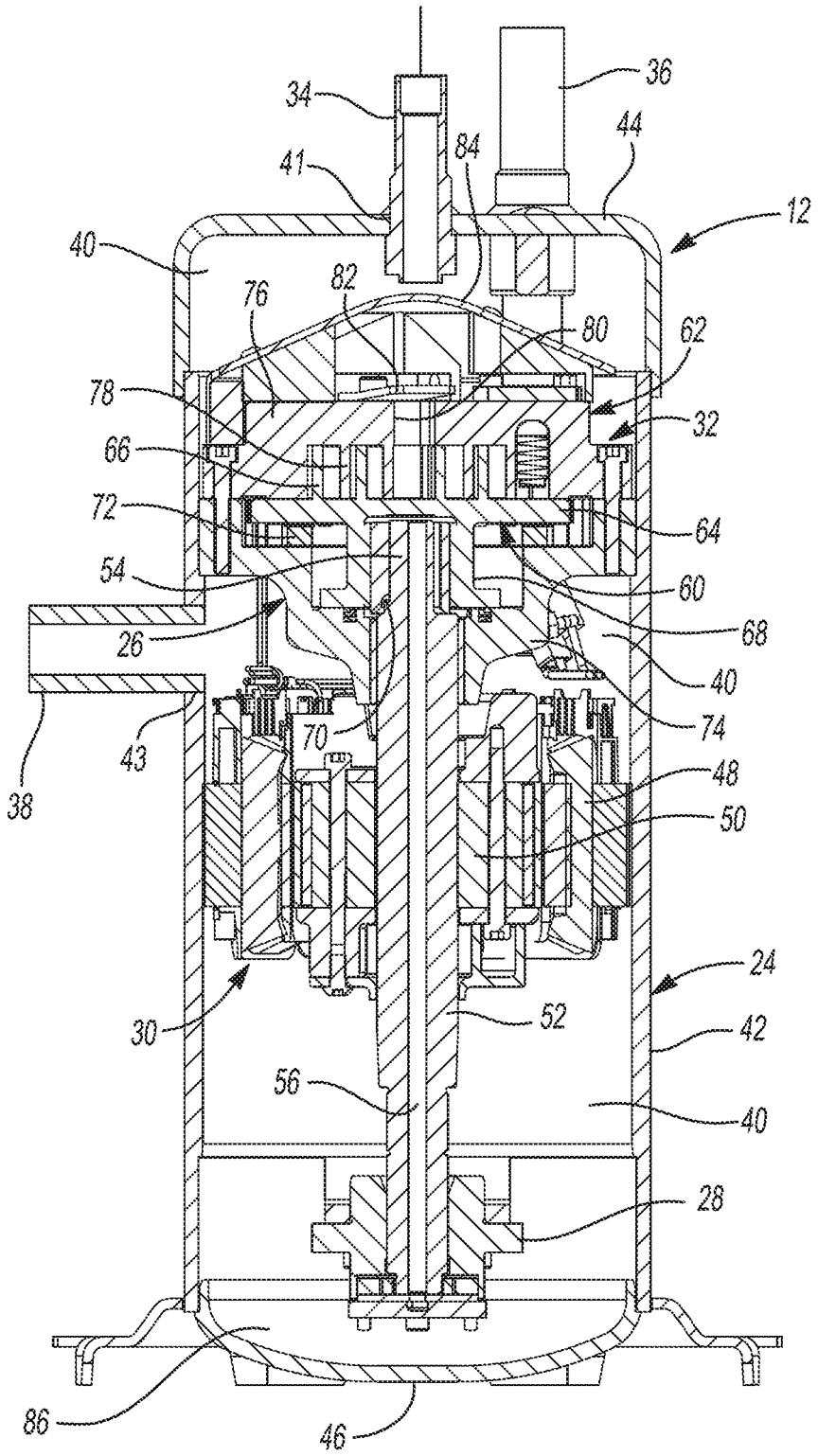

FIG. 1 is a schematic representation of a climate-control system according to the principles of the present disclosure; and FIG. 2 is a cross-sectional view of an exemplary compressor that can be incorporated into the climate-control system of FIG. 1.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system is provided that may include a fluid circuit having a first compressor 12, a second compressor 14, a first heat exchanger 16 (an outdoor heat exchanger such as a condenser or gas cooler, for example), a flash tank 18 (or an economizer heat exchanger), a second heat exchanger 20 (an indoor heat exchanger such as a medium-temperature evaporator, for example), and a third heat exchanger 22 (an indoor heat exchanger such as a low-temperature evaporator, for example). One or both of the compressors 12, 14 may pump working fluid (e.g., refrigerant, carbon dioxide, etc.) through the fluid circuit. In some configurations, the system 10 could include a reversing valve (not shown) operable to switch the system 10 between a cooling mode and a heating mode or defrost mode.

Referring now to FIG. 2, the first compressor 12 may be a high-side scroll compressor including a hermetic shell assembly 24, a first and second bearing assemblies 26, 28, a motor assembly 30, a compression mechanism 32, a discharge fitting 34, a first inlet fitting 36, and a second inlet fitting 38. The shell assembly 24 may define a high-pressure discharge chamber 40 and may include a cylindrical shell 42, an end cap 44 at an upper end thereof, and a base 46 at a lower end thereof.

The discharge fitting 34 may be attached to the end cap 44 and extend through a first opening 41 in the end cap 44 to provide fluid communication between the discharge chamber 40 and a first discharge line 47 (FIG. 1) extending between the first and second compressors 12, 14. The first inlet fitting 36 may be attached to the end cap 44 and extend through a second opening (not shown) in the end cap 44. The first inlet fitting 36 may extend through a portion of the discharge chamber 40 and is fluidly coupled to a suction inlet of the compression mechanism 32. In this manner, the first inlet fitting 36 provides fluid communication between a first suction line 49 and the compression mechanism 32 while fluidly isolating the low-pressure (e.g., suction-pressure) working fluid from the first suction line 49 from the high-pressure working fluid in the discharge chamber 40. The second inlet fitting 38 may be attached to the shell 42 at a third opening 43 in the shell 42 and fluidly communicates with the discharge chamber 40.

The motor assembly 30 may be disposed entirely within the discharge chamber 40 and may include a motor stator 48, a rotor 50, and a drive shaft 52. The motor stator 48 may be press fit into the shell 42. The rotor 50 may be press fit on the drive shaft 52 and may transmit rotational power to the drive shaft 52. The drive shaft 52 may be rotatably supported by the first and second bearing assemblies 26, 28. The drive shaft 52 may include an eccentric crank pin 54 and a lubricant passageway 56.

The compression mechanism 32 may be disposed entirely within the discharge chamber 40 and may include an orbiting scroll 60 and a non-orbiting scroll 62. The orbiting scroll 60 may include an end plate 64 having a spiral wrap 66 extending therefrom. A cylindrical hub 68 may project downwardly from the end plate 64 and may include a drive bushing 70 disposed therein. The crank pin 54 may drivingly engage the drive bushing 70. An Oldham coupling 72 may be engaged with the orbiting scroll 60 and either the non-orbiting scroll 62 or a bearing housing 74 of the first bearing assembly 26 to prevent relative rotation between the orbiting and non-orbiting scrolls 60, 62.

The non-orbiting scroll 62 may include an end plate 76 and a spiral wrap 78 projecting downwardly from the end plate 76. The spiral wrap 78 may meshingly engage the spiral wrap 66 of the orbiting scroll 60, thereby creating a series of moving fluid pockets therebetween. The fluid pockets defined by the spiral wraps 66, 78 may decrease in volume as they move from a radially outer position (at a low pressure) to a radially intermediate position (at an intermediate pressure) to a radially inner position (at a high pressure) throughout a compression cycle of the compression mechanism 32. The end plate 76 may include a discharge passage 80 in communication with one of the fluid pockets at the radially inner position and allows compressed working fluid (at the high pressure) to flow into the discharge chamber 40. A discharge valve 82 may provide selective fluid communication between the discharge passage 80 and the discharge chamber 40. An oil separator 84 may be mounted to the end plate 76 between the discharge passage 80 and the discharge fitting 34. Oil in the working fluid discharged from the compression mechanism 32 may impinge on the oil separator 84 and drip down into a lubricant sump 86 defined by the base 46 of the shell assembly 24.

While the first compressor 12 is described above as a high-side scroll compressor (i.e., a compressor in which the motor assembly is disposed within a discharge-pressure chamber within the shell), in some configurations, the first compressor 12 could be a low-side compressor (i.e., a compressor in which the motor assembly is disposed within a suction-pressure chamber within the shell). For example, the first compressor 12 could be a high-side or low-side compressor such as a rotary, reciprocating, or screw compressor, or any other suitable type of compressor. It will be appreciated that either or both of the first and second compressors 12, 14 may include some form of capacity modulation, such as mechanical modulation and/or vapor injection, for example, to vary the output of one or both of the compressors 12, 14. In some configurations, one or more of the compressors 12, 14 may have different capacities than one or more of the other compressors 12, 14. In some configurations, one or more of the compressors 12, 14 may include a fixed-speed or variable-speed motor.

Referring again to FIG. 1, the second compressor 14 can be similar or identical to the first compressor 12 or any other suitable low-side or high-side compressor, such as a scroll, rotary, reciprocating or screw compressor, for example. The second compressor 14 includes a compression mechanism 88 disposed within a shell 90 having an inlet 92 (e.g., a first inlet fitting) and an outlet 94 (e.g., an outlet fitting). The inlet 92 may provide fluid to a suction inlet 89 of the compression mechanism 88 (e.g., a radially outermost pocket of a scroll compression mechanism). An inlet line 96 may be fluidly connected the first discharge line 47 and the inlet 92. In this manner, working fluid compressed by the first compressor 12 can exit the first compressor 12 through the discharge fitting 34 and then flow through the first discharge line 47, the inlet line 96 and the inlet 92 to be further compressed by the compression mechanism 88 of the second compressor 14. In some configurations, the inlet 92 can include or be coupled to a direct suction conduit that extends into the shell 90 to isolate or partially isolate working fluid therein from gas and/or heat within the shell 90. After the working fluid is further compressed by the compression mechanism 88 of the second compressor 14, the working fluid (e.g., working fluid exiting a discharge port 91, which may receive working fluid from a radially innermost pocket of a scroll compression mechanism) can be discharged from the second compressor 14 through the outlet 94 to a second discharge line 98.

The second discharge line 98 may be fluidly coupled to an inlet of the first heat exchanger 16. High-pressure working fluid from the second discharge line 98 can be cooled in the first heat exchanger 16 by transferring heat from the working fluid to ambient air or another cooling medium (e.g., water). From the first heat exchanger 16, the working fluid may flow through a first expansion device 100 (e.g., an expansion valve or capillary tube), thereby lowering the temperature and pressure of the working fluid. From the first expansion device 100, the working fluid may flow into an inlet 102 of the flash tank 18.

In the flash tank 18, liquid working fluid is separated from vapor working fluid. Liquid working fluid may exit the flash tank 18 through a liquid outlet 104. Vapor working fluid may exit the flash tank 18 through a vapor outlet 106. From the liquid outlet 104, working fluid may flow through a second expansion device 108 (e.g., an expansion valve or capillary tube) to further lower its temperature and pressure. A first portion of the working fluid exiting the second expansion device 108 can flow into a first liquid conduit 110 fluidly coupled with the second heat exchanger 20. In the second heat exchanger 20, the working fluid may absorb heat from a first space to be cooled. Working fluid exiting the second heat exchanger 20 can flow through into the inlet line 96 of the second compressor 14 (via conduit 111) for subsequent compression in the second compressor 14 (e.g., inlet line 96 and conduit 111 may at least partially define a fluid path extending from an outlet of the second heat exchanger 20 to the first inlet 92 of the second compressor 14).

A second portion of the working fluid exiting the second expansion device 108 can flow into a second liquid conduit 112 fluidly coupled with a third expansion device 114 (e.g., an expansion valve or capillary tube) and the third heat exchanger 22. Flowing through the third expansion device 114 further lowers the temperature and pressure of the working fluid (relative to the temperature and pressure of the working fluid in the first liquid conduit 110). Upon exiting the third expansion device 114, the working fluid may flow into the third heat exchanger 22. In the third heat exchanger 22, the working fluid may absorb heat from a second space to be cooled. Working fluid exiting the third heat exchanger 22 can flow through into the first suction line 49 and into the first inlet fitting 36 for compression in the first compressor 12 (e.g., the first suction line 49 at least partially defines a fluid path extending from an outlet of the third heat exchanger 22 to the first inlet 36 of the first compressor 12).

From the vapor outlet 106 of the flash tank 18 the vapor working fluid can flow into a first vapor conduit 116 or a second vapor conduit 118. The working fluid that flows into through the first vapor conduit 116 may flow through a fourth expansion device 120 (e.g., an expansion valve or capillary tube) to lower its temperature and pressure before flowing into the inlet line 96 of the second compressor 14, which is fluidly coupled with the first vapor conduit 116 downstream of the fourth expansion device 120. As shown in FIG. 1, fluid in conduits 47, 111, 116 may all merge and flow through the inlet line 96 to the inlet 92 of the second compressor 14 for compression within the compression mechanism 88. In other words, the first vapor conduit 116 may at least partially define a fluid path extending from the vapor outlet 106 of the flash tank 18 to another fluid path at least partially defined by the conduit 111 and inlet line 96.

The second vapor conduit 118 may be fluidly coupled with the second inlet fitting 38 of the first compressor 12. That is, the second vapor conduit 118 may at least partially define a fluid path that is coupled to the second inlet 38 of the first compressor 12 and transmits working fluid from the vapor outlet 106 to the second inlet 38. A control valve 122 disposed along the second vapor conduit 118 may control the flow of working fluid through the second inlet fitting 38 into the shell 24 of the first compressor 12. It will be appreciated that the control valve 122 could be disposed inside of the shell 24 of the first compressor 12 or outside of the shell 24. Because the vapor working fluid exiting the flash tank 18 through the vapor outlet 106 is at a higher fluid pressure than the working fluid discharged by the compression mechanism 32 of the first compressor 12, a pump may not be necessary to achieve the flow of working fluid through the second vapor conduit 118 to the second inlet fitting 38.

A control module 124 may control operation of the control valve 122 based on a temperature within the shell 24 of the first compressor 12. The control valve 122 could be any suitable fluid-control device, such as a solenoid valve (e.g., controlled by a pulse-width-modulated signal or any other control signal), an electronic expansion valve, or a solenoid valve with a fixed expansion device (e.g., a capillary tube or orifice), for example. In some configurations, one or more sensors (not shown) may be positioned within and/or attached to the shell 24 to sense a temperature of one or more of the motor assembly 30, oil in the lubricant sump 86 and gas within the discharge chamber 40. In some configurations, the temperature sensor(s) may be disposed along the first discharge line 47 or the discharge outlet 34. The one or more sensors can communicate the temperature data to the control module 124. Based on the data received from the sensor (e.g., if the sensed temperature is higher or lower than a predetermined threshold temperature or temperature range), the control module 124 can open and close the control valve 122 to selectively allow and prevent vapor working fluid to flow into the shell 24 through the second inlet fitting 38. The vapor working fluid that enters the shell 24 through the second inlet fitting 38 may circulate or flow throughout the discharge chamber 40 to cool the motor assembly 30 and/or the oil within the shell 24 and may subsequently exit the first compressor 12 through the discharge outlet 34. The vapor working fluid that enters the first compressor 12 through the second inlet fitting 38 is not recompressed by the compression mechanism 32 and remains isolated from fluid in the first inlet fitting 36 and fluid in the compression pockets between the spiral wraps 66, 78.

It will be appreciated that other methods for controlling the control valve 122 may be employed. In some configurations, the control valve 122 could be a thermally-actuated valve that employs phase-changing materials and/or expanding/contracting materials that are responsive to heat within the discharge chamber 40. Any suitable valve structure and/or control method could be employed.

The above approach to cooling the motor assembly 30 and/or oil of the first compressor 12 (i.e., providing working fluid from the conduit 118 to the discharge chamber 40) is advantageous in that it provides sufficient capacity to cool the motor assembly 30 and/or oil without compromising efficiency of the system 10. Such cooling of the motor assembly 30 and/or oil may be particularly beneficial for the first compressor 12 due to the positioning of the oil separator 84 inside of the shell 24 between the discharge passage 80 and the discharge fitting 34. That is, while the oil separator 84 very effectively removes oil from working fluid discharged from the compression mechanism 32, the oil separator 84 may also hinder the flow of discharge gas down to the motor assembly 30 and lubricant sump 86. Therefore, working fluid can be directed into the shell 24 through the second inlet fitting 38 to sufficiently cool the motor assembly 30 and/or oil.

In some configurations, a third vapor conduit 119 may be fluidly connected with the vapor outlet 106 of the flash tank 18 in parallel with the first and second vapor conduits 116, 118. The third vapor conduit 119 may be fluidly coupled with a second inlet fitting 93 of the second compressor 14. That is, the third vaport conduit 119 may at least partially define a fluid path that is coupled to the second inlet 93 of the second compressor 14 and transmits working fluid from the vapor outlet 106 to the second inlet 93. The second inlet fitting 93 of the second compressor 14 can be in fluid communication with an internal volume within the shell 90 in which the motor assembly is disposed, for example. In this manner, fluid entering the second compressor 14 through the second inlet fitting 93 can circulate within the internal volume within the shell to cool the motor assembly and/or other compressor components therein. A control valve 123 disposed along the third vapor conduit 119 may control the flow of working fluid through the second inlet fitting 93 into the shell 90 of the second compressor 14. It will be appreciated that the control valve 123 could be disposed inside of the shell 90 of or outside of the shell 90. Because the vapor working fluid exiting the flash tank 18 through the vapor outlet 106 is at a higher fluid pressure than the working fluid discharged by the compression mechanism 32 of the first compressor 12, a pump may not be necessary to achieve the flow of working fluid through the third vapor conduit 119 to the second inlet fitting 93.

The structure and function of the control valve 123 could be similar or identical to the control valve 122 described above. That is, operation of the control valve 123 could be controlled by the control module 124 based on a temperature of one or more of the motor assembly of the second compressor 14, oil in a lubricant sump of the second compressor 14, a discharge temperature of the second compressor 14 and/or a temperature of gas in a suction chamber or discharge chamber of the second compressor 14. In this manner, the vapor working fluid from the vapor outlet 106 of the flash tank 18 may be distributed among the first, second and third vapor conduits 116, 118, 119 by controlling the valves 122, 123 and expansion device 120, as demand dictates.

While FIG. 1 depicts the system 10 having the second and third vapor conduits 118, 119, in some configurations, the system 10 could include the second vapor conduit 118 and not the third vapor conduit 119. In some configurations, the system 10 could include the third vapor conduit 119 and not the second vapor conduit 118.

In configurations of the system 10 that include the second vapor conduit 118, the first compressor 12 may be a high-side compressor. In configurations of the system 10 that include the third vapor conduit 119, the second compressor 14 may be a low-side compressor. In configurations of the system 10 that include both of the second and third vapor conduits 118, 119, the first compressor 12 may be a high-side compressor and the second compressor 14 may be a low-side compressor. In configurations of the system 10 that do not include the third vapor conduit 119, the second compressor 14 may be a high-side or a low-side compressor. In configurations of the system 10 that do not include the second vapor conduit 118, the first compressor 12 may be a high-side or a low-side compressor.

In some configurations, a fourth vapor conduit 133 may be fluidly connected with the vapor outlet 106 of the flash tank 18 in parallel with the first, second and third vapor conduits 116, 118, 119. The fourth vapor conduit 133 may be fluidly coupled with a third inlet fitting 135 of the second compressor 14. That is, the fourth vapor conduit 133 may at least partially define a fluid path fluidly connecting the vapor outlet 106 to the third inlet 135 of the second compressor 14. The third inlet fitting 135 may be coupled with an intermediate vapor-injection port 95 of the compression mechanism 88 (i.e., for injection of intermediate-pressure vapor into an intermediate-pressure location within the compression mechanism 88). For example, the intermediate vapor-injection port 95 may be in fluid communication with an intermediate-pressure compression pocket disposed radially between the radially outermost pocket that receives fluid from the suction inlet 89 and the radially innermost pocket that provides fluid to the discharge port 91. A control valve 131 disposed along the fourth vapor conduit 133 may control the flow of working fluid through the third inlet fitting 135 into the vapor-injection port 95 of the second compressor 14. It will be appreciated that the control valve 131 could be disposed inside of the shell 90 of or outside of the shell 90. The control valve 131 can be an ON/OFF solenoid valve, an electronic expansion valve, or any other type of valve.

Operation of the control valve 131 could be controlled by the control module 124 based on a temperature of one or more of the motor assembly of the second compressor 14, oil in a lubricant sump of the second compressor 14, a discharge temperature of the second compressor 14 and/or a temperature of gas in a suction chamber or discharge chamber of the second compressor 14, as well as temperature and pressure leaving the first heat exchanger 16, for to improve capacity and/or efficiency, for example. In this manner, the vapor working fluid from the vapor outlet 106 of the flash tank 18 may be distributed among the first, second, third and fourth vapor conduits 116, 118, 119, 133 by controlling the valves 122, 123, 131 and expansion device 120, as demand dictates.

In this application, including the definitions below, the term "module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a first compressor having a first compression mechanism, a first inlet, a second inlet and an outlet, the first compression mechanism receiving working fluid from the first inlet and discharging the working fluid through the outlet;

a second compressor in fluid communication with the first compressor and having a second compression mechanism receiving working fluid from the outlet of the first compressor;

a first heat exchanger in fluid communication with the second compressor and receiving working fluid from the second compressor;

a flash tank in fluid communication with the first heat exchanger and receiving working fluid from the first heat exchanger, the flash tank including a vapor outlet and a liquid outlet;

a second heat exchanger in fluid communication with the flash tank and receiving working fluid from the liquid outlet;

a first fluid path extending from an outlet of the second heat exchanger to a first inlet of the second compressor, wherein the first fluid path is fluidly isolated from the first inlet of the first compressor, and wherein working fluid in the first fluid path flows from the outlet of the second heat exchanger to the first inlet of the second compressor without flowing through the first compressor;

a second fluid path extending from the vapor outlet of the flash tank to the first fluid path; and a third fluid path coupled to the second inlet of the first compressor, the third fluid path transmitting working fluid from the vapor outlet to the second inlet.

2. The climate-control system of claim 1, wherein working fluid entering the first compressor through the second inlet is fluidly isolated from the first compression mechanism.

3. The climate-control system of claim 2, wherein working fluid flowing through the third fluid path is at a higher pressure than working fluid flowing through the outlet of the first compressor.

4. The climate-control system of claim 3, wherein the second fluid path includes an expansion device, and wherein working fluid in the second fluid path downstream of the expansion device is at a pressure substantially equal to the working fluid flowing through the outlet of the first compressor.

5. The climate-control system of claim 1, further comprising a third heat exchanger in fluid communication with the flash tank and receiving working fluid from the liquid outlet; and a fourth fluid path extending from an outlet of the third heat exchanger to the first inlet of the first compressor.

6. The climate-control system of claim 5, wherein the second and third fluid paths bypass the second and third heat exchangers.

7. The climate-control system of claim 6, further comprising a pair of expansion devices through which working fluid from the liquid outlet of the flash tank passes before entering the third heat exchanger, and wherein working fluid from the liquid outlet of the flash tank passes through only one of the pair of expansion devices before entering the second heat exchanger, and wherein the second and third heat exchangers are fluidly isolated from each other.

8. The climate-control system of claim 1, wherein the first compression mechanism compresses working fluid from a first pressure to a second pressure, and wherein the second compression mechanism compresses the working fluid from the second pressure to a third pressure.

9. The climate-control system of claim 1, wherein the third fluid path includes a valve controlling fluid flow through the second inlet.

10. The climate-control system of claim 9, wherein the valve is controlled based on a temperature within a shell of the first compressor.

11. The climate-control system of claim 1, wherein the first inlet of the second compressor receives working fluid from the outlet of the first compressor, and wherein the climate-control system further comprises a fourth fluid path coupled to a second inlet of the second compressor, the fourth fluid path transmitting working fluid from the vapor outlet to the second inlet of the second compressor.

12. The climate-control system of claim 11, further comprising a fifth fluid path fluidly connecting the vapor outlet to a third inlet of the second compressor, wherein the third inlet is fluidly connected to a vapor-injection port of the second compression mechanism.

13. The climate-control system of claim 1, wherein the first compression mechanism includes first and second scrolls defining fluid pockets therebetween that contain working fluid from the first inlet.

14. The climate-control system of claim 1, wherein the first compressor includes a shell assembly that defines a discharge chamber, wherein the outlet of the first compressor receives fluid from the discharge chamber, wherein the second inlet of the first compressor is open to the discharge chamber such that the second inlet of the first compressor provides fluid directly to the discharge chamber, and wherein the first inlet of the first compressor is isolated from direct fluid communication with the discharge chamber.

15. The climate-control system of claim 14, wherein the second compressor includes a second inlet and a third inlet, wherein the third inlet is fluidly connected to a vapor-injection port of the second compression mechanism.

16. A climate-control system comprising:

a first compressor having an outlet and a first compression mechanism discharging the working fluid through the outlet;

a second compressor in fluid communication with the first compressor and having a first inlet, a second inlet, and a second compression mechanism receiving working fluid from the first inlet, the first inlet receiving working fluid from the outlet of the first compressor;

a first heat exchanger in fluid communication with the second compressor and receiving working fluid from the second compressor;

a flash tank in fluid communication with the first heat exchanger and receiving working fluid from the first heat exchanger, the flash tank including a vapor outlet and a liquid outlet;

a second heat exchanger in fluid communication with the flash tank and receiving working fluid from the liquid outlet;

a first fluid path extending from an outlet of the second heat exchanger to the first inlet of the second compressor, wherein the first fluid path is fluidly isolated from a first inlet of the first compressor, and wherein working fluid in the first fluid path flows from the outlet of the second heat exchanger to the first inlet of the second compressor without flowing through the first compressor;

a second fluid path extending from the vapor outlet of the flash tank to the first fluid path; and a third fluid path coupled to the second inlet of the second compressor, the third fluid path transmitting working fluid from the vapor outlet to the second inlet.

17. The climate-control system of claim 16, wherein the first compressor includes a second inlet.

18. The climate-control system of claim 17, wherein the first compressor includes a shell assembly that defines a discharge chamber, wherein the outlet of the first compressor receives fluid from the discharge chamber, wherein the second inlet of the first compressor is open to the discharge chamber such that the second inlet of the first compressor provides fluid directly to the discharge chamber, and wherein the first inlet of the first compressor is isolated from direct fluid communication with the discharge chamber.

19. The climate-control system of claim 18, wherein the second compressor includes a third inlet that is fluidly connected to a vapor-injection port of the second compression mechanism.

* * * * *